US008240099B2

(12) United States Patent
Hummel, III

(10) Patent No.: US 8,240,099 B2
(45) Date of Patent: Aug. 14, 2012

(54) ARCHITECTURAL PANEL SYSTEM

(75) Inventor: Frank "Trip" A. Hummel, III, Minooka, IL (US)

(73) Assignee: DORALCO, Inc., Alsip, IL (US)

( * ) Notice: Subject to any disclaimer, the term of this patent is extended or adjusted under 35 U.S.C. 154(b) by 142 days.

(21) Appl. No.: 12/843,730

(22) Filed: Jul. 26, 2010

(65) Prior Publication Data

US 2012/0017530 A1 Jan. 26, 2012

(51) Int. Cl.
*E04B 2/00* (2006.01)

(52) U.S. Cl. ..... 52/506.05; 52/506.01; 52/235; 52/474; 52/506.06

(58) Field of Classification Search ..... 52/506.01, 52/506.05, 506.06, 506.07, 506.08, 510, 52/512, 747.1, 235, 474
See application file for complete search history.

(56) References Cited

U.S. PATENT DOCUMENTS

| | | | | |
|---|---|---|---|---|
| 4,021,987 | A | 5/1977 | Schnebel et al. | |
| 4,307,551 | A | 12/1981 | Crandell | |
| 4,483,122 | A | 11/1984 | Crandell | |
| 4,506,484 | A | 3/1985 | Bartlett et al. | |
| 4,622,794 | A | 11/1986 | Geortner | |
| 4,625,481 | A | 12/1986 | Crandell | |
| 4,768,321 | A | 9/1988 | Crandell | |
| 4,866,896 | A | 9/1989 | Shreiner et al. | |
| 5,265,396 | A | 11/1993 | Amimoto | |
| 5,809,729 | A * | 9/1998 | Mitchell | 52/474 |
| 5,829,216 | A | 11/1998 | Newcomb et al. | |
| 6,035,598 | A | 3/2000 | Sukolics et al. | |
| 6,098,364 | A | 8/2000 | Liu | |
| 6,330,772 | B1 | 12/2001 | Mitchell et al. | |
| 6,484,465 | B2 | 11/2002 | Higgins | |
| 6,748,709 | B1 | 6/2004 | Sherman et al. | |
| 7,716,891 | B2 | 5/2010 | Radford | |
| 8,033,066 | B2 * | 10/2011 | Griffiths | 52/235 |
| 8,127,507 | B1 * | 3/2012 | Bilge | 52/235 |
| 2002/0124514 | A1 | 9/2002 | Higgins | |
| 2007/0022682 | A1 * | 2/2007 | Morgenegg et al. | 52/235 |
| 2007/0119105 | A1 * | 5/2007 | MacDonald et al. | 52/235 |
| 2009/0145071 | A1 | 6/2009 | Radford | |
| 2009/0241451 | A1 * | 10/2009 | Griffiths | 52/309.4 |
| 2010/0037549 | A1 * | 2/2010 | Lynch et al. | 52/506.08 |
| 2010/0263314 | A1 * | 10/2010 | MacDonald et al. | 52/506.05 |

* cited by examiner

*Primary Examiner* — Robert Canfield
*Assistant Examiner* — Matthew Gitlin
(74) *Attorney, Agent, or Firm* — Greer, Burns & Crain, Ltd.

(57) ABSTRACT

An architectural panel system including a plurality of architectural panels, a first mounting extrusion attached to a first architectural panel, and a second mounting extrusion attached to a second architectural panel, as well as a first anchor clip including a first attachment configuration that enables the first mounting extrusion to be slidably attached thereto, and a second anchor clip including a second attachment configuration that enables the second mounting extrusion to be slidably attached thereto. The system also includes a panel joint filler strip. The first mounting extrusion includes a first pocket portion, and the second mounting extrusion includes a second pocket portion that is shallower than the first pocket portion. The first and second pocket portions cooperate with each other to seat the panel joint filler strip. Also disclosed are methods of installing the panel system and of replacing a damaged panel of an installed array of panels.

9 Claims, 10 Drawing Sheets

ARCHITECTURAL PANEL SYSTEM

The present application relates generally to an architectural panel system, and more particularly to an architectural panel system that includes a mounting configuration, for at least some panels, that utilizes a mounting extrusion with an enlarged pocket portion for temporarily holding back a panel joint filler strip during anchor clip attachment, and that facilitates repair and/or replacement of one or more panels without disturbing the adjacent panels. The application also relates to methods of initially installing such an architectural panel system, as well as to methods of repairing and/or replacing one or more panels in such a system.

SUMMARY

One embodiment of the present architectural panel system includes a plurality of architectural panels, first and second mounting extrusions, a pair of anchor clips and a panel joint filler strip. In this embodiment, each of the plurality of architectural panels includes at least one folded edge portion, but typically, all edges will be folded over with a 90° return leg. Additionally, the first mounting extrusion is preferably defined between a first distal portion and a first proximal portion, wherein the first distal portion is configured and arranged to so that the folded edge portion of a first one of the architectural panels can be attached thereto. Preferably, the second mounting extrusion is defined between a second distal portion and a second proximal portion, wherein the second distal portion is configured and arranged so that the folded edge portion of a second one of the architectural panels can be attached thereto. Also, the first anchor clip of the pair preferably includes a first attachment configuration that enables the first proximal portion to be slidably attached thereto, and the second anchor clip of the pair includes a second attachment configuration that enables the second proximal portion to be slidably attached thereto.

Moreover, in one embodiment, the first mounting extrusion includes a first pocket portion in an area between the first distal portion and the first proximal portion and the second mounting extrusion includes a second pocket portion in an area between the second distal portion and the second proximal portion, wherein the first pocket portion and the second pocket portion are configured and arranged to cooperate with each other to seat the joint filler strip. Finally, the first pocket portion is of a first depth and the second pocket portion is of a second depth that is less than the first depth. Preferably, the first pocket portion is of a depth that is slightly smaller than a width of the filler strip so that when the filler strip is inserted into the first pocket portion, only a small portion of the filler strip extends outside of the first pocket portion.

BRIEF DESCRIPTION OF THE SEVERAL VIEWS OF THE DRAWINGS

Preferred embodiments of the present invention are described herein with reference to the drawings wherein.

DETAILED DESCRIPTION

Figure 1:
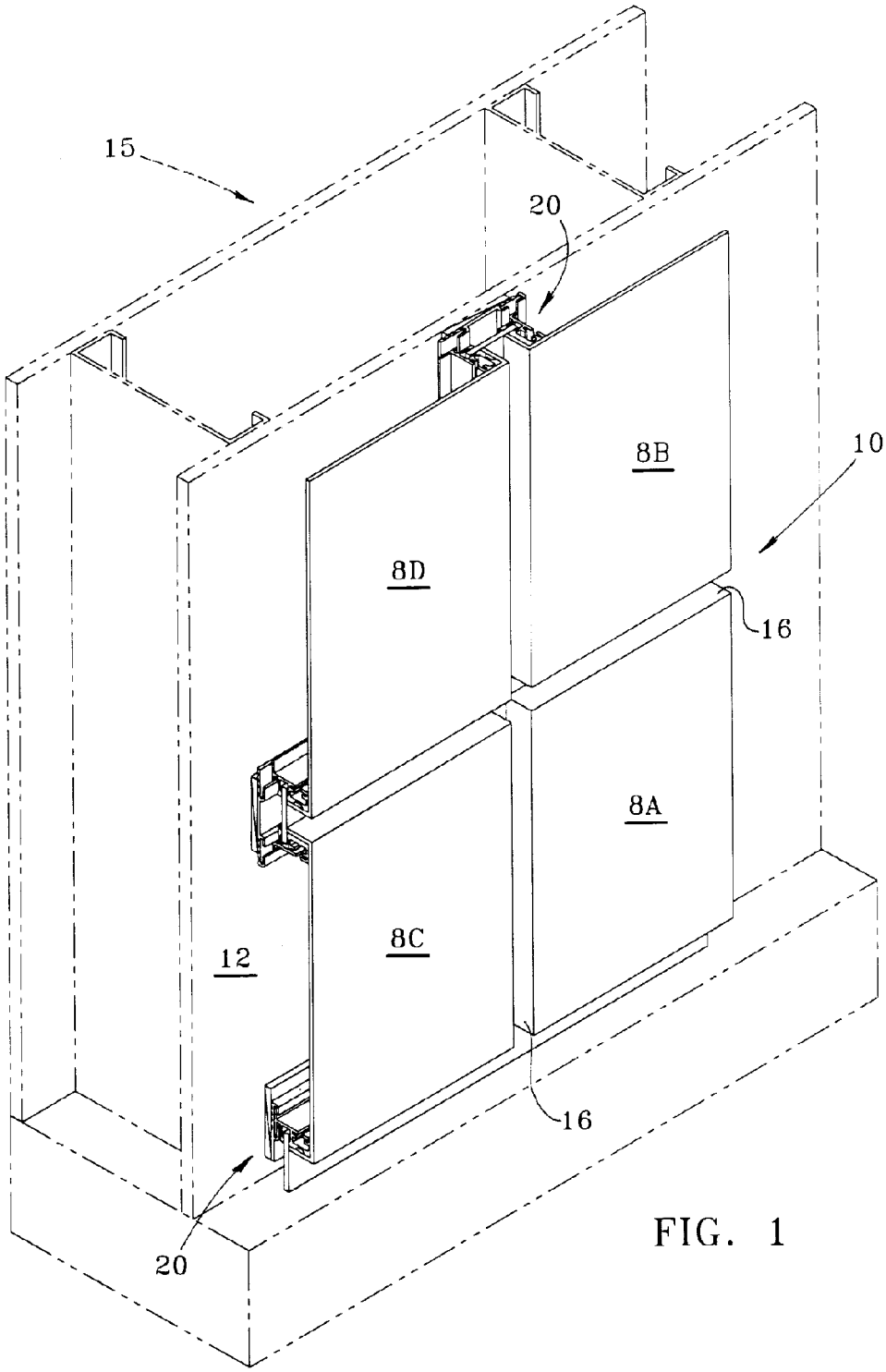
FIG. 1 is a perspective view of one embodiment of the present architectural panel system, showing four panels installed upon a building exterior.

Turning now FIGS. 1-5, a preferred embodiment of the present architectural panel system is shown and will be described. FIG. 1 is a perspective view that shows four panels (8A, 8B, 8C and 8D) of the present panel system 10 attached to the sheathing 12 of a building 15 (partially shown). Panels 8A-8D may be made of any suitable material, such as known aluminum composite panels where two thin aluminum (or other metal) sheets sandwich a plastic core. Preferably, the panels 8A-8D each include at least one folded edge portion 16, and typically all edges are folded. In the embodiment shown in the figures, the panels 8A-8D are each square or rectangular in shape. However, it is contemplated that panels of other shapes, such as triangles, hexagons, or other polygons, may also be used with the present system. Also, although the panels shown in the drawings are all of the same shape, multiple different shapes may be used within the same system.

As can be seen in FIG. 1, the panels 8A-8D are attached to the sheathing 12 via a support system 20 that, in this embodiment, is in the form of an array or grid consisting of horizontally extending members and vertically extending members. Although FIG. 1 shows the horizontal and vertical members at right angles to each other, such a configuration is not required, especially where the panels are not rectangular. Further, in addition to being installed upon the exterior of a vertical wall, as shown in FIG. 1, it is also contemplated that the panels could be installed on other areas, both interior and exterior, such as on angled walls, horizontal or angled ceilings, roofs, soffits, facias, etc.

Figure 2:
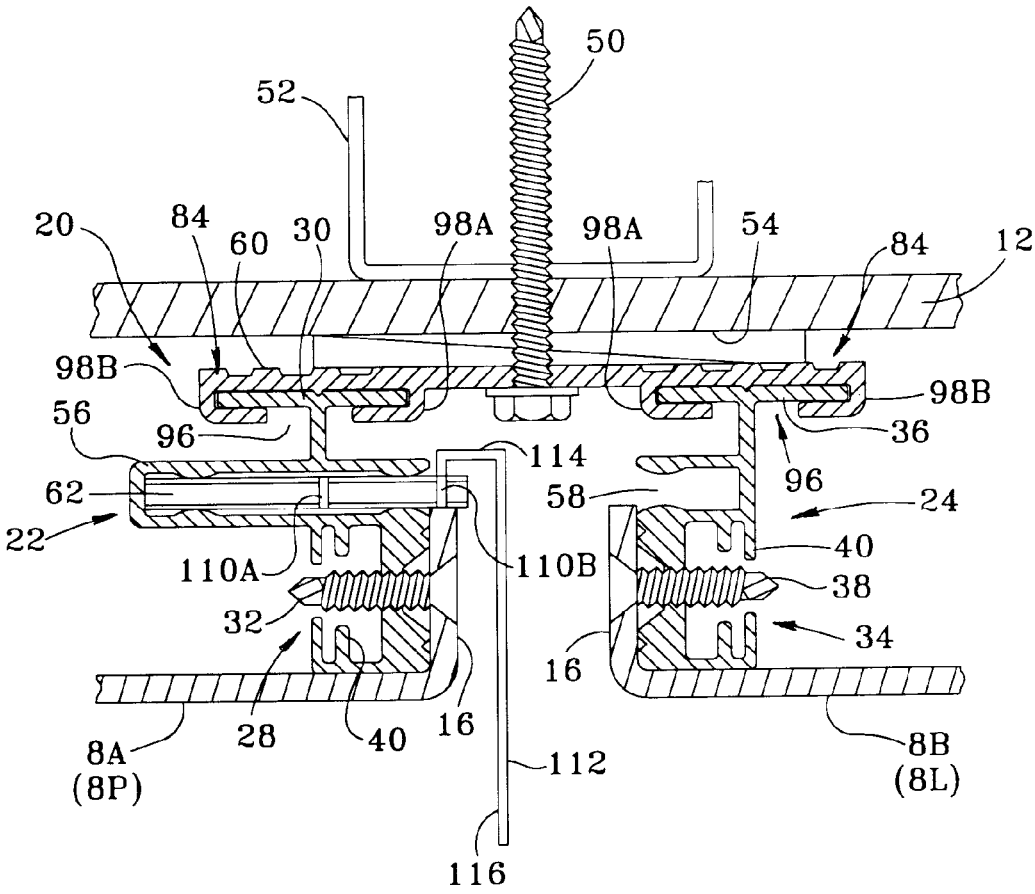
FIG. 2 is a cross-sectional view of portions of two adjacent panels of the present architectural panel system, showing how the panels are attached to the building exterior, and also showing the joint filler strip seated within the pocket of elongated depth.
Figure 6:
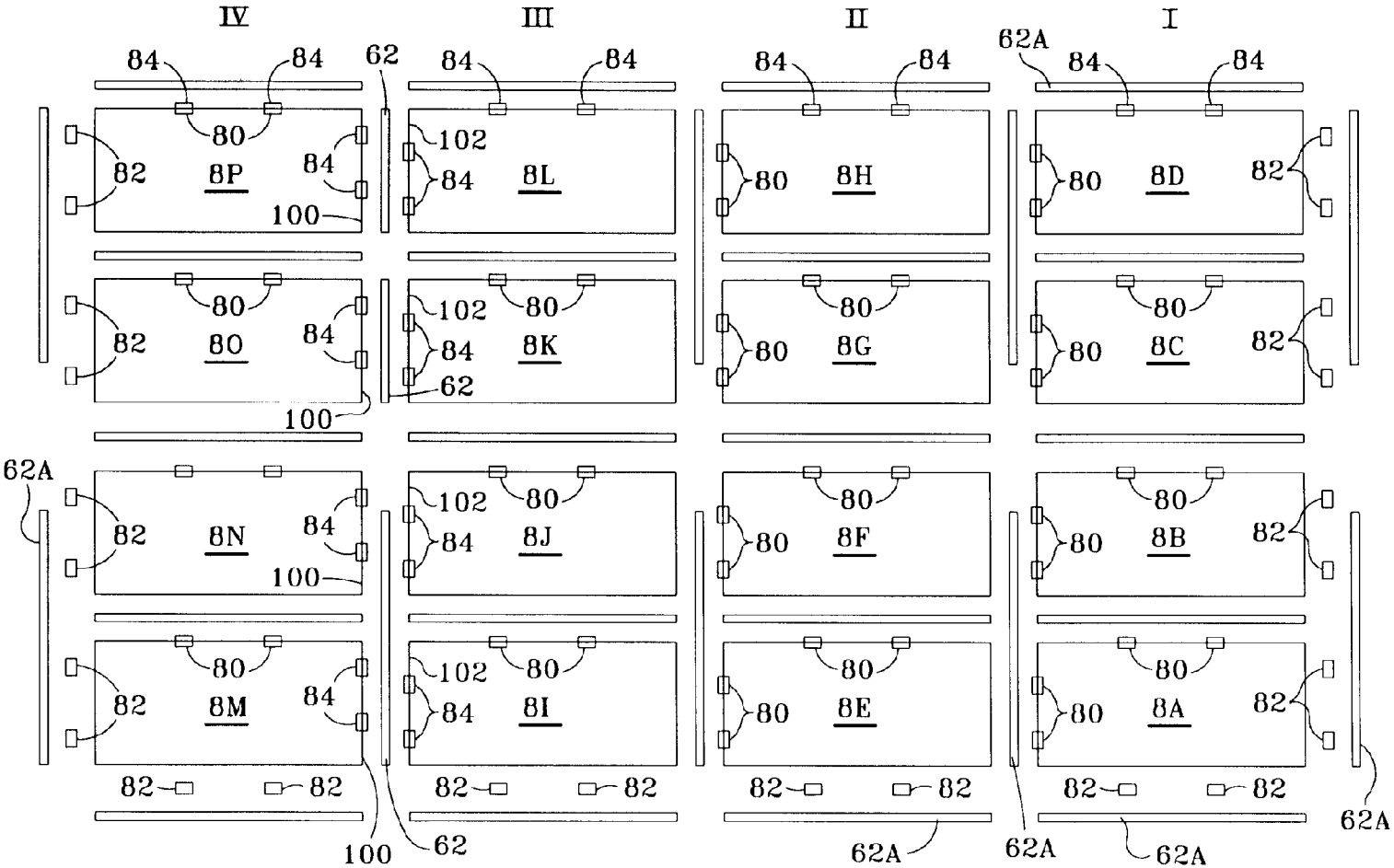
FIG. 6 is a plan view of an example installation of one embodiment of the architectural panel system of the present invention.
Figure 10:
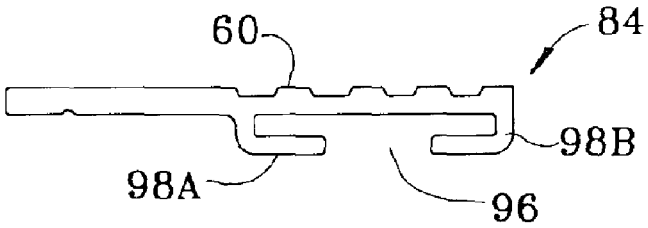
FIG. 10 is another different type of anchor clip, which may be used, for example, as termination clip, such as a clip used near the upper edges of an array of panels or between the second to last column and the last column in an array of panels.

Turning now to FIG. 2, this figure shows a cross-sectional view of two panels, 8A and 8B, installed upon the sheathing 12. More specifically, FIG. 2 shows two architectural panels, 8A and 8B, where each panel including at least one folded edge portion 16. In this embodiment, the support system 20 includes a first mounting extrusion 22, a second mounting extrusion 24 and a pair of anchor clips 84. The anchor clips 84 (where a single clip is best shown in FIG. 10) are staggered, such as shown in FIG. 6, between the left column of panels (column IV) and the adjacent column (column III).

The first and second mounting extrusions, 22 and 24, and the anchor clips 84 are preferably made of an extruded metal material, such as aluminum. However, other metal and non-metal materials are also contemplated as being suitable materials for the extrusions, as well as other clip formation methods besides extruding.

In this embodiment, the first mounting extrusion 22, is defined between a first distal portion 28 and a first proximal portion 30. The first distal portion 28 is configured and arranged so that the folded edge portion 16 of the architectural panel 8A can be attached thereto, such as via threaded fastener 32. More specifically, in this embodiment, fastener 32 can be inserted through an aperture in the folded edge portion 16 and then into a corresponding threaded aperture in the first mounting extrusion 22. As can be seen in FIG. 2, the first distal portion 28 of this embodiment is generally U-shaped, in cross-section (with the opening facing towards the left-hand side of the figure). Preferably, the first distal portion 28 also includes one or more sets of strengthening ribs 40 on each side of its U-shaped cross-section.

Similar to the first mounting extrusion, the second mounting extrusion 24 is preferably defined between a second distal portion 34 and a second proximal portion 36, with the second distal portion being configured and arranged so that the folded edge portion 16 of the architectural panel 8B can be attached thereto, via threaded fastener 38, in the same manner described above for the first mounting extrusion 22. Of course, other means of attaching panels 8A and 8B to the extrusions 22 and 24, besides threaded fasteners, are also contemplated. The second distal portion 34 is also generally U-shaped in cross-section, similar to the first distal portion 28, and also optionally includes one or more sets of strengthening ribs 40.

Turning now to the proximal portions (30, 36) of the first and second mounting extrusions (22, 24), one example of a configuration for attaching the extrusions 22, 24 to the anchor clips 84 will be described. In this embodiment, both proximal portions 30, 36 are generally T-shaped in cross-section, as can be seen in FIG. 2. The T-shaped proximal portions 30, 36 are configured to be seated within an appropriately shaped receiving slot 96, formed as part of each anchor clip 84. More specifically, each receiving slot 96 consists of a pair of elongated members 98A, 98B that are generally L-shaped in cross-section. Thus, as can be seen in FIG. 2, each receiving slot 96, which could also be called an attachment configuration, is configured to slidably receive one of either T-shaped proximal portion 30 of the first mounting extrusion 22 or T-shaped proximal portion 36 of the second mounting extrusion 24. Other embodiments of attachment configurations are also contemplated.

Figure 3:
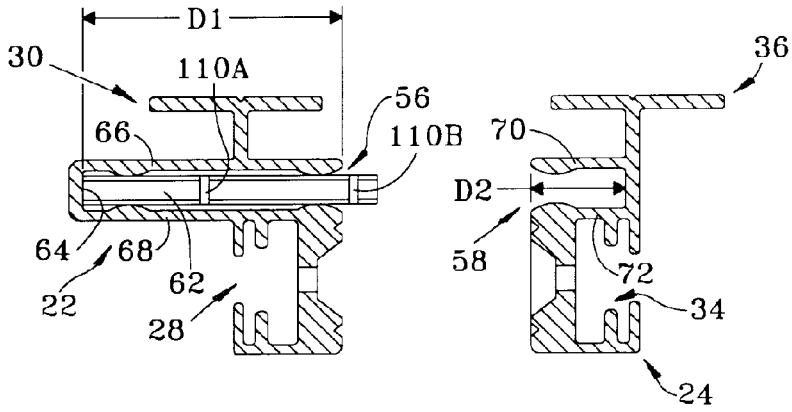
FIG. 3 is an enlarged view of the first and second mounting extrusions and the joint filler strip, shown without the anchor clip or other components to better show the details of the mounting extrusions.

In the embodiment shown in the figures, the first T-shaped proximal portion 30 is directly connected to one leg 66 of the first U-shaped pocket portion 56 and the other leg 68 of the first U-shaped shaped pocket portion 56 is shared with the first U-shaped distal portion 28, as best shown in FIG. 3. Similarly, the second T-shaped proximal portion 36 is directly connected to one leg 70 of the second U-shaped pocket portion 58 and the other leg 72 of the second U-shaped shaped pocket portion 58 is shared with the second U-shaped distal portion 34. Although such direct relationships between the pocket portions and the proximal and distal portions are shown in the drawings, it is contemplated that indirect relationships between these portions of the extrusion may also be used, such as by adding an I-shaped member, or other-shaped member, between the pocket portion and the distal portion.

Turning back to FIG. 2, the anchor clips 84 can be attached to the sheathing 12 by any desired method, such as with a plurality of spaced apart threaded fasteners 50 (one shown), which extend through each clip 84 and into the sheathing 12. Preferably, the fasteners extend into a metal stud 50. Other configurations for attaching the clips 84 to the building 15 are also contemplated. Optionally, one or more spacer shims 54 may be used between each anchor clip 84 and the sheathing 12, if necessary, to obtain the desired spacing and/or alignment between these two components. The spacer shims 54 may be made of plastic, or other suitable material, and could be of any known shape, such as the well-known horseshoe style.

As an additional optional feature, this embodiment includes four longitudinally extending reinforcing ribs 60 formed on the sheathing facing surface of the anchor clip 84. Such ribs 60 provide strength to the anchor clip 84, while allowing for reduced thickness between the ribs. Although four ribs 60 are shown in the figures, a greater or lesser number of ribs may also be used, or the ribs may be omitted entirely, depending on the dimensions of the clip and the circumstances of use.

One of the important features of the present architectural panel system 10 relates to respective pocket portions 56, 58 of the first and second mounting extrusions 22, 24. More specifically, the first mounting extrusion 22 includes a first pocket portion 56 between the distal portion 28 and the proximal portion 30. As can be seen in FIG. 2, the first pocket portion 56 is generally U-shaped in cross-section, with an opening that faces in the opposite direction from the opening of the generally U-shaped first distal portion 28.

Similarly, the second mounting extrusion 24 also includes a second pocket portion 58 between its distal portion 34 and its proximal portion 36. As with the first pocket portion 56 of the first mounting extrusion 22, the second pocket portion 58 is also generally U-shaped in cross-section, with its opening facing in the opposite direction from the opening of the associated U-shaped second distal portion. In addition, in the assembled state shown in FIG. 2, the opening of the second U-shaped pocket portion 58 (of the second mounting extrusion 24) faces the opening of the first U-shaped pocket portion 56 (of the first mounting extrusion 22). This configuration allows the first pocket portion 56 and the second pocket portion 58 to cooperate with each other to seat the joint filler strip 62.

One important difference between the first pocket portion 56 of the first mounting extrusion 22 and the second pocket portion 58 of the second mounting extrusion 24 is that the first pocket portion 56 is of a different depth than the second pocket portion 58. More specifically, for the reasons that will be explained below, the first pocket portion 56 is much deeper than the second pocket portion 58, where each pocket's depth is considered as being the distance from its open end to the base of the pocket.

Turning now to FIG. 3, the pocket depths will be discussed. FIG. 3 is an enlarged version of the cross-section of FIG. 2, except showing only the first and second mounting extrusions (22, 24), with a joint filler strip 62 seated within the first pocket portion 56, without including the other components.

More specifically, FIG. 3 shows how the depth D1 of the first pocket portion 56 of the first mounting extrusion 22 is much deeper than the depth D2 of the second pocket portion 58 of the second mounting extrusion 24. Preferably, the depth D1 is just slightly smaller than the corresponding width of the joint filler strip 62, such that the joint filler strip 62 extends only slightly outside of the second pocket portion 58 when seated against the base 64 of the second pocket portion. Further, in this embodiment, the depth D1 is at least about three times the depth D2. The reason for the different depths D1 and D2 will be discussed below, when discussing the steps involved in installing the panel system upon a building wall or other surface.

Three examples of different types of anchor clips will be discussed next, while referring to FIGS. 8-10. In the preferred embodiment of the present system, all three different types of anchor clips are used, with each being configured to be used at different locations of the array. Preferably, each of the anchor clips is relatively short, compared with the length of one of the sides of one of the panels. For example, each anchor clip shown in FIGS. 8-10, as well as all other anchor clips used for the present invention, can be between about 2 and 10 inches in length, with anchor clips between 3 and 4 inches in length being most preferred. Further, the anchor clip 84 of FIG. 10 is the same as shown in FIG. 2, but it has been included again in FIGS. 8-10 for ease of comparison of the three types of clips.

Figure 8:
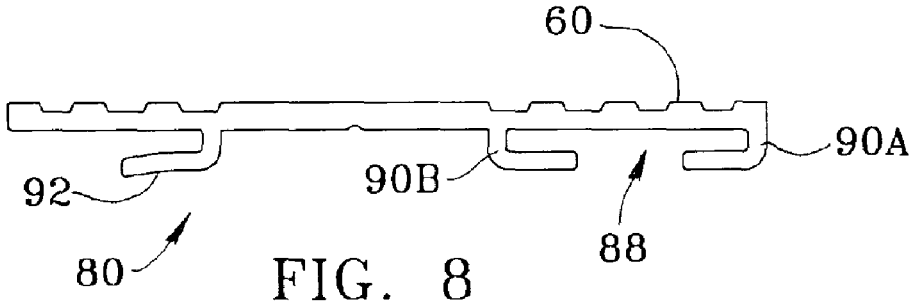
FIG. 8 is a side view of the main type of anchor clip of FIG. 7, shown without the associated components.

FIG. 8 shows anchor clip 80, which can be considered as the basic or standard anchor clip of the present invention, as it is the most common one used in the array of panels of this example. Anchor clip 80 includes, on one side thereof, a receiving slot 88 defined by L-shaped members 90A and 90B. Receiving slot 88, which could be referred to as the "claw" type or double L-shape, is configured to slidably receive a T-shaped member, such as either of the proximal portions 30 or 36 of mounting extrusion 22 or 24, respectively, of FIG. 2. The other side of anchor clip 80 includes another receiving configuration, which is in the form of a single L-shaped member, designated as L-shaped member 92, and which can be referred to as the J-hook type, hook type or single L-shape. The L-shaped member 92 is also configured to receive a T-shaped member, such as either of the T-shaped proximal portions 30 or 36 of mounting extrusion 22 or 24, respectively, of FIG. 2. However, since the receiving configuration defined by L-shaped member 92 is open on one side, the T-shaped member need not be slid axially between two L-shaped members (as it does with L-shaped members 90A and 90B), but it may instead be inserted from the open side (i.e., from the left-hand side as viewed in FIG. 8). The use of a receiving configuration with only a single L-shaped member (such as 92) and an open side also allows for thermal expansion of the panels.

Figure 9:
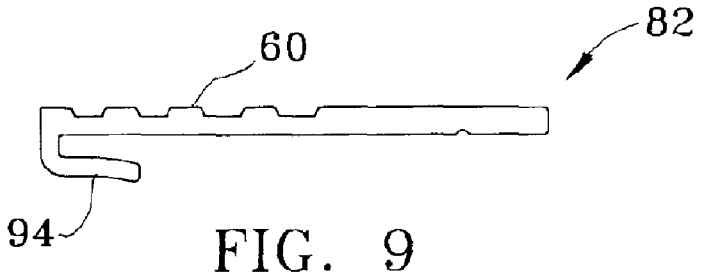
FIG. 9 is a different type of anchor clip, which clip may be used, for example, as a starter clip or as a clip near certain edges of an array of panels.

Turning now to FIG. 9, anchor clip 82 will be described next. Anchor clip 82 can be considered as a "starter" clip, as this type of clip is typically used when starting a new row or column of panels, as will be described below when describing the installation process. Starter anchor clip 82 includes a J-hook type receiving configuration that is formed of a single L-shaped member 94, and thus functions in a similar manner to the receiving configuration of single L-shaped member 92 of FIG. 8.

Turning to FIG. 10, anchor clip 84 will be described. Anchor clip 84 can be considered as a "termination" clip, as this type of clip can be used in the gap between the last two columns (or last two rows) of panels being installed in an array. Termination anchor clip 84 includes, on one side thereof, a receiving slot 96 defined by L-shaped members 98A and 98B (i.e., the claw type). Receiving slot 96, like receiving slot 88 of FIG. 8, is configured to slidably receive a T-shaped member, such as either of the proximal portions 30 or 36 of mounting extrusion 22 or 24, respectively, of FIG. 2.

As a general rule of thumb, a typical four sided panel is supported on two of its sides by anchor clips of the claw type and on two of its sides by anchor clips of the J-hook type. For example, panel 8F of FIG. 6 is supported on its right and bottom edges by the J-hook (single L-shaped member 92 of FIG. 8) of anchor clip 80, and on its top and left edges by the claw portion (slot 88 of FIG. 8) of anchor clip 80.

A description of one example of a method of installing the panels of the system will be discussed next, while referring primarily to FIG. 6, which is a schematic showing one example of an array of panels 8 (listed as panels 8A-8P), as well as many of the related components used when installing the panels upon the surface. The example array shown in FIG. 6 is an array of 16 panels, including 4 rows and 4 columns, but of course any number of panels may be provided in an array, and the array may be made of any desired number of rows and any desired number of columns.

Preferably, the installation of the panels of the present system, which is a progressive installation system, starts in one of the corners, such as with one of the lower corners. In this example, we will start with the lower right corner, with panel 8A. On the rear surface of each of the panels, unless otherwise noted, are four mounting extrusions, such as mounting extrusion 24 of FIG. 2, with one mounting extrusion running parallel and adjacent each of the four edges of each panel. As mentioned earlier, mounting extrusion 24 includes a relatively shallow pocket portion 58 (when compared to the relatively deep pocket portion 56 of mounting extrusion 22 of FIG. 2). This is the case because, in this example of an initial installation of an array of panels, the deep pocket mounting extrusion 22 is only used on one edge of each of the panels of the final column of panels, or in the penultimate column of panels, as discussed below. However, as also discussed below, during the replacement process (in which a single panel of an already installed array of panels is to be replaced), the deep pocket mounting extrusions 22 are used on all edges of the replacement panel.

Prior to installing any panels upon the surface (of the wall, ceiling, roof, or other part of the building intended to receive the array of panels), the mounting extrusions (24, in most cases, or 22) are attached to the rear surface of the panels 8, along each of the edges. The mounting extrusions are typically attached to the panels (with, for example, threaded fasteners 32 and 38 of FIG. 2) at the fabrication facility, prior to shipping the panels to the job site. However, on-site installation of the mounting extrusions is also possible.

Figure 7:
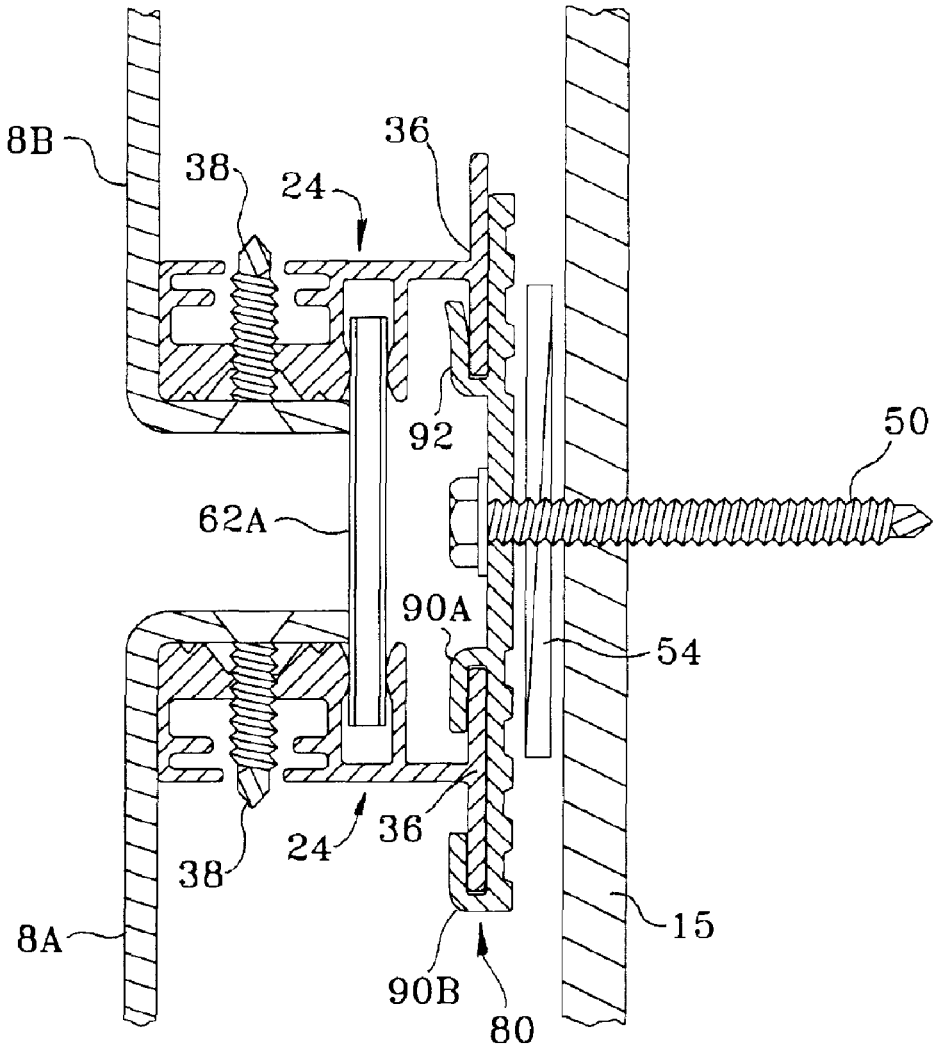
FIG. 7 is a side view of one example of the main type of anchor clip, shown in relation to its associated components.
Figure 7A:
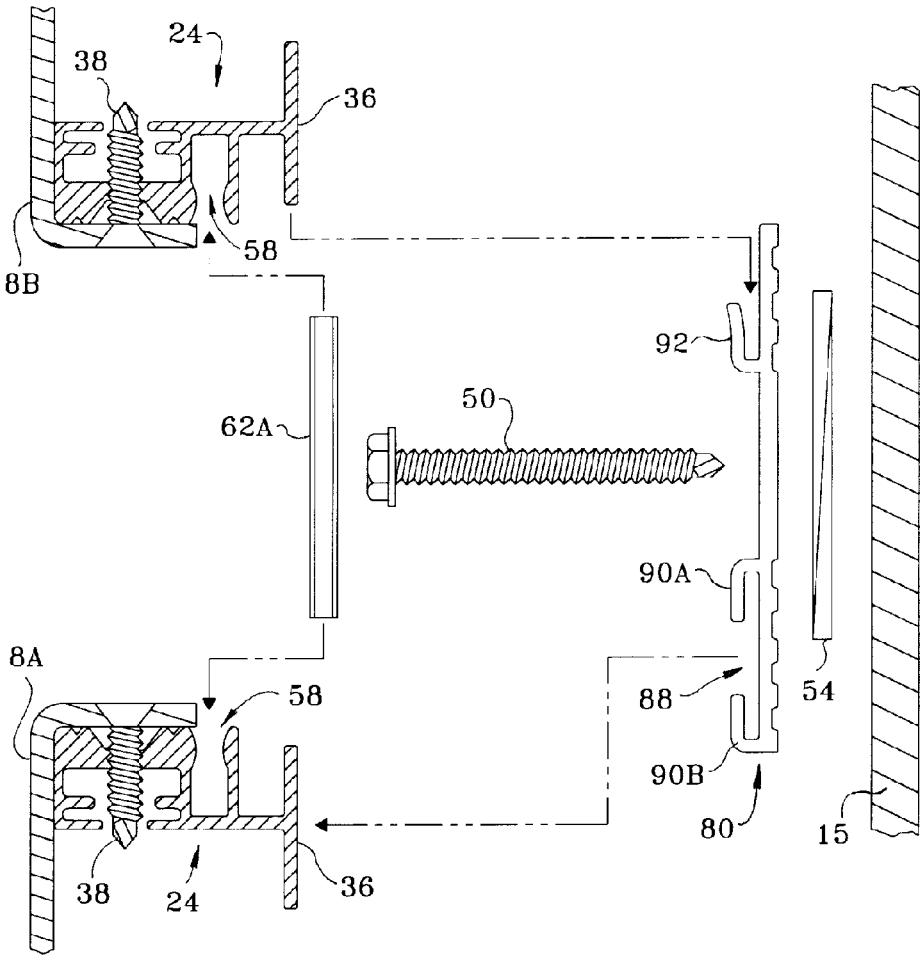
FIG. 7A is an exploded view of FIG. 7.

For the first panel 8A, four anchor clips 80 are attached, at the positions shown in FIG. 6, to the mounting extrusions 24 (see FIG. 7). More specifically, the mounting extrusions 24 each include one or more notches (not shown) in the outer leg of T-shaped proximal portion 36 along the length thereof, and by positioning the anchor clip 80 within the gap, and then sliding the clip in the axial direction of the extrusion, the receiving slot 88 (FIG. 7) will receive the T-shaped proximal portion 36 between the pair of L-shaped members 90A and 90B. The anchor clips 80 can be maintained in position upon the extrusion by any desired method, such as with screws, tape, crimping the extrusion, etc.

After all four starter anchor clips 82 have been attached to the surface of the building, the panel 8A can be moved into position. Thus, the L-shaped member 94 of starter anchor clip 82 (FIG. 9) will connect with the T-shaped proximal portion 36 (FIG. 3) of the mounting extrusion 24. Once in the desired position, the anchor clips 80 can be attached to the building substrate via threaded fasteners 80 (FIG. 7).

At this point, one of the panel joint filler strips 62A may be slid or placed into position between the bottom of the panel 8A and the trim (not shown) at the base of the array. More specifically, the panel joint filler strip 62A can be slid or placed into one of the pocket portions 58 (such as shown in FIG. 7) and the trim (not shown) in the horizontal direction. Although the exact details of the order of installing the panel joint filler strips are up to the installer's preference, the typical order for installing panels such as panels 8A-8C is to first install the lower horizontal strip, then the vertical right side strip, then to install panel 8A, then the horizontal strip between panels 8A and 8B, then to install panel 8B, then to install the strip above panel 8B, then to install panel 8C, then the strips above and to the right of 8C, then to install panel 8D, then the strip above panel 8D, then the strip above panel 8D, then the strip below panel 8E, then the strip between 8E and 8A, etc.

In this example, the installation will proceed upwardly next, to panel 8B. However, if desired, the process can continue horizontally instead, to panel 8E. In general, for the entire array, progress to the next panel can be made either vertically or horizontally to the next adjacent panel.

For panel 8B, there are four anchor clips 80 attached thereto, in the positions shown in FIG. 6, using the same process described above for attaching clips 80 to panel 8A. Since the lower edge of panel 8B will be using the upper portions of anchor clips 80 of panel 8A, only two of the starter anchor clips 82 need to be installed to the surface of the building in the location shown in FIG. 6 (instead of the four starter anchor clips 82 needed for panel 8A). More specifically, FIG. 7 shows how the T-shaped proximal portion 36 of the mounting extrusion 24 on the lower edge of panel 8B can be inserted into the L-shaped member 92 on the upper portion of anchor clip 80.

Once panel 8B is located in the desired position of the array, anchor clips 80 can be attached to the building surface 15 via threaded apertures 50. Also, at this point, the panel joint filler strip 62A between panels 8A and 8B (FIGS. 6 and 7) can be slid or placed into position between pocket portions 58, as shown in FIG. 7. The panel joint filler strip 62A on the right side, which is of double height so it will cover the right peripheral side gap of both panel 8A and panel 8B, can also be slid into position.

Panel 8C, and its associated components, can be installed in the same manner as panel 8B. Panel 8D is installed in a similar manner to panels 8B and 8C, except instead of using anchor clips 80 on the upper edge of panel 8D, termination anchor clips 84 are used. Termination anchor clips 84 are used instead of anchor clips 80 because no additional panels are to be installed above panel 8D, and thus only the single receiving slot 96 (FIG. 10) is needed, instead of the two receiving configurations of clip 80 (i.e., as shown in FIG. 8, the two receiving configurations include receiving slot 88 and L-shaped member 92). Thus, the first column of panels (column I) is now complete.

Panels 8E through 8H of column II are installed, in order from E to H, as shown in FIG. 6, using the appropriate anchor clips (80, 82 or 84), as designed in FIG. 6. Since the use of clips 80, 82 and 84 is the same for panels 8E through 8H as that described for panels 8A through 8D, further description of the installation of these panels is unnecessary.

Figure 4:
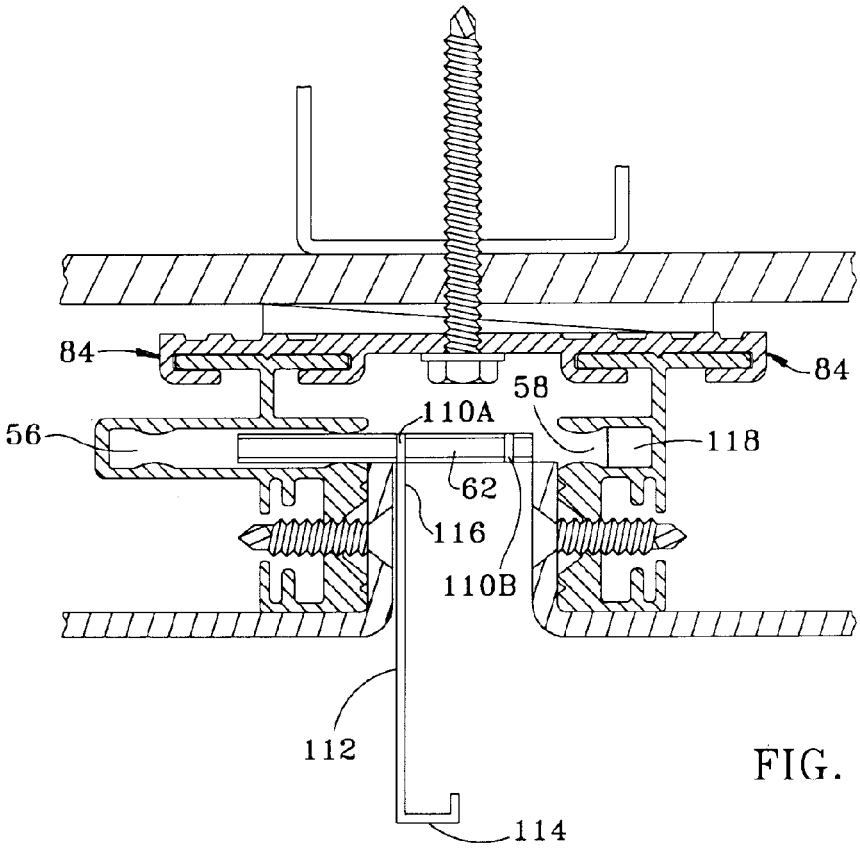
FIG. 4 is a cross-section, similar to that of FIG. 2, except showing the joint filler strip being moved partially out of the elongated pocket with a filler strip sliding tool.

Turning now panels 8I through 8P, which are the last two columns of the array (columns III and IV), the installation of these panels will be discussed because these panels include the use of mounting extrusions with deeper pocket portions, such as extrusion 28 of FIGS. 2-4. More specifically, either the right edges 100 of panels 8M through 8P (column IV) or the left edges 102 of panels 8I through 8L (column III) include the deep pocket mounting extrusion 22.

The termination anchor clips 84 are attached to panels 8I through 8P in a staggered manner, as shown in FIG. 6. For example, comparing the locations of clips 84 on panel 8I with those on panel 8M, one can see how they are staggered so that they do not interfere with each other when the gap between panels 8I and 8M is reduced when the panels are actually installed (as compared to the schematic view of FIG. 6).

The column including panels 8I through 8L (column III) are attached to the surface, in order from I to L, using the anchor clips 80, 82 and 84, positioned where indicated in FIG. 6 in the appropriate manner described above for each particular type of anchor clip. Then, the column including panels 8M through 8P (column IV) are attached to the surface, in order from M to P, using the appropriate clips (80, 82 and 84) positioned as in FIG. 6 and in the appropriate installation manner.

Another difference between the installation method of the last two columns and that of the remainder of the columns in the array (other than the use of staggered termination anchor clips 84, instead of anchor clips 80, and the use of the deep pocket mounting extrusion 22 at edges 100 or edges 102) is that in the last two columns, panel joint filler strip 62 (FIGS. 2-5) is used, instead of panel joint filler strip 62A (FIG. 7), and such panel joint filler strip 62 is preferably seated within the deep pocket portion 56 prior to attaching the associated panel to the surface (instead of sliding panel joint filler strip 62A in position after attaching the associated panels to the surface, as done with the other columns of panels). As can be seen in FIGS. 2-5, panel joint filler strip 62 also includes at least one pair of apertures 110A,110B, which are configured and arranged to receive a sliding tool 112 (FIGS. 2 and 4), while panel joint filler strip 62A (FIG. 7) lacks such apertures. As will be apparent, additional pairs of apertures may also be provided on panel joint filler strip 62 if necessary, especially in cases where the strip is very long (such as greater than about 36 inches).

Figure 5:
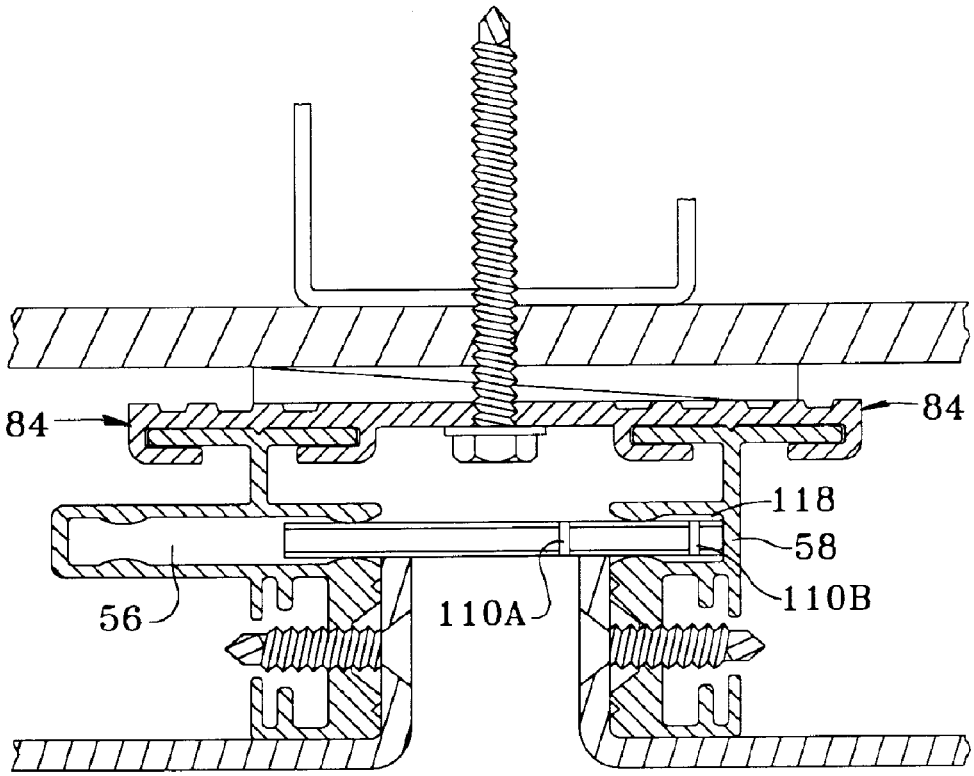
FIG. 5 is a cross-section, similar to that of FIGS. 2 and 4, except showing the joint filler strip seated in its final position within both pockets.

Thus, because the panel joint filler strip 62 is seated within deep pocket 56, such as in FIG. 2, there is open access to the front of each of the clips 84 for securing threaded fasteners 50 through each clip 84 and into sheathing 12. After the threaded fasteners 50 have been inserted, the panel joint filler strip 62 can be moved to cover the gap between the two adjacent panels. Such a process preferably involves a sliding tool 112. More specifically, as can be seen in FIG. 2, the hook end 114 of the sliding tool 112 is used to slide panel joint filler strip 62 at least part way out of deep pocket portion 56, towards shallow pocket portion 58, of an adjacent panel. That is, the hook end 114 is inserted into aperture 110B, and the panel joint filler strip 62 is moved as far towards the adjacent pocket as possible (i.e., to the right, in the FIG. 2 example). Then, the hook end 114 of the sliding tool is removed from aperture 110B. Next, the straight end 112 is inserted into the other aperture (aperture 110A), as shown in FIG. 4, and the panel joint filler strip 62 is moved from the position of FIG. 4 to the position of FIG. 5. Preferably, as shown in FIG. 4, an adhesive material 118 has been provided in the shallow pocket portion 58 prior to such sliding process, such that the adhesive material 118 will surround the end of panel joint filler strip 62, as shown in FIG. 5, and maintain the strip in position within the pocket.

Thus, one example of a method of installing an array of panels has been shown and described. Of course, modifications from the method just described are contemplated as being within the scope of the invention.

Next, an example of a process of using the deep pocket mounting extrusion 22 on a replacement panel will be described. At any time after the installation of a panel, such as after the entire array has been in use for a period of time, or even before completion of installation of the full array, one or more panels of the array may become damaged and need to be replaced. Conventional systems usually require a "rewind" of the installation process by removing all panels installed after the damaged panel, in reverse order of installation, to obtain access to the damaged panel, as such conventional systems are usually progressive systems (in other words, the panels are removed in the reverse order in which they were installed). With such progressive systems, replacement of a single panel can be time consuming and costly because of the need to remove and replace other undamaged panels in order to obtain access to a damaged panel.

In contrast, by using the deep pocket mounting extrusion 22 described herein, replacement of a damaged panel can be accomplished more efficiently because only the damaged panel needs to be removed and replaced, regardless of the inclusion of adjacent panels that were installed after the damaged panel. The replacement process described herein can be applied to an array such as that of the FIG. 6 example, or it can be applied to a conventional progressive array.

Figure 11:
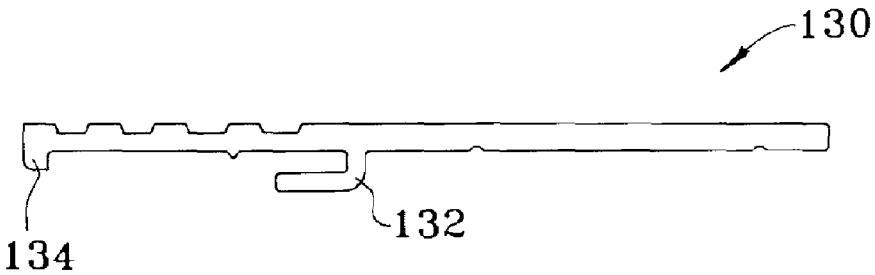
FIG. 11 is a side view of another different type of anchor slip, which clip may be used, for example, as a replacement clip during a panel replacement process.

Preferably, the replacement process uses a replacement-type anchor clip 130, such as that shown in FIG. 11. Of course, variations on the configuration are contemplated as being within the scope of the invention. As can be seen in FIG. 11, anchor clip 130 includes a receiving portion defined by an L-shaped member 132 and a raised lip 134.

Figure 12:
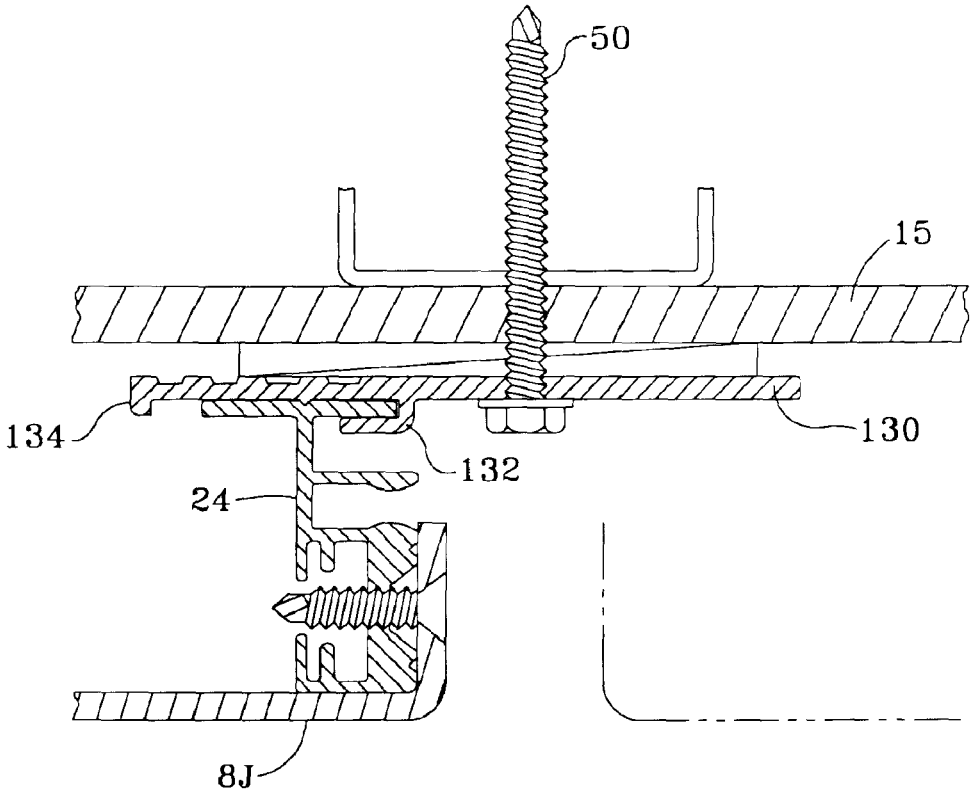
FIG. 12 is a side view of a step in the panel replacement process, showing the insertion of a replacement anchor clip for a panel adjacent the panel being replaced.

The first step of the replacement process is to remove the damaged panel. This can be achieved by cutting through the damaged panel (such as by cutting a large "x" into the face of the panel) so that the associated anchor clips can be accessed and removed. For example, assuming that panel 8F of FIG. 6 was damaged, panel 8F could be cut so that the upper and right-side anchor clips 80 are accessible. Then, these four anchor clips 80 are removed. The lower and right side anchor clips 80 are maintained in position to help support panels 8E and 8B, respectively. Next, since the lower anchor clips 80 for panel 8G and the right hand side anchor clips 80 for panel 8J have been removed, new support needs to be provided for these two panels. Thus, as shown in FIG. 12, replacement anchor clips 130 are provided as shown in the figure. Preferably, anchor clips 130 are provided near the locations where clips 80 were previously located. A similar set of replacement clips 130 is also provided below panel 8G to provide support where anchor clips 80 have been removed.

Next, the replacement panel 8F'can be installed. The replacement panel 8F' includes a deep pocket extrusion 22 (FIG. 2) on its upper and left edges. Additionally, prior to installation, a panel joint filler strip 62, with apertures 110A/110B (FIG. 2) is inserted into the deep pocket portion 56. Also prior to installation, at least two anchor clips 84 (FIG. 10) are attached to each of the two deep pocket mounting extrusions 22 (assuming a rectangular panel), such as by positioning the anchor clip at the notch in the extrusion, and then sliding the clip with the receiving portion 96 (FIG. 10) of the clip mated with the T-shaped proximal portion 30 (FIG. 3) until reaching the desired position. Preferably, the clips 84 are positioned to be staggered from the replacement anchor clips 130 of the adjacent panel (as shown between columns IV and III of FIG. 6). The anchor clips 84 are preferably secured in position upon the mounting extrusion 22 by screws or any other desired attachment means.

Figure 13:
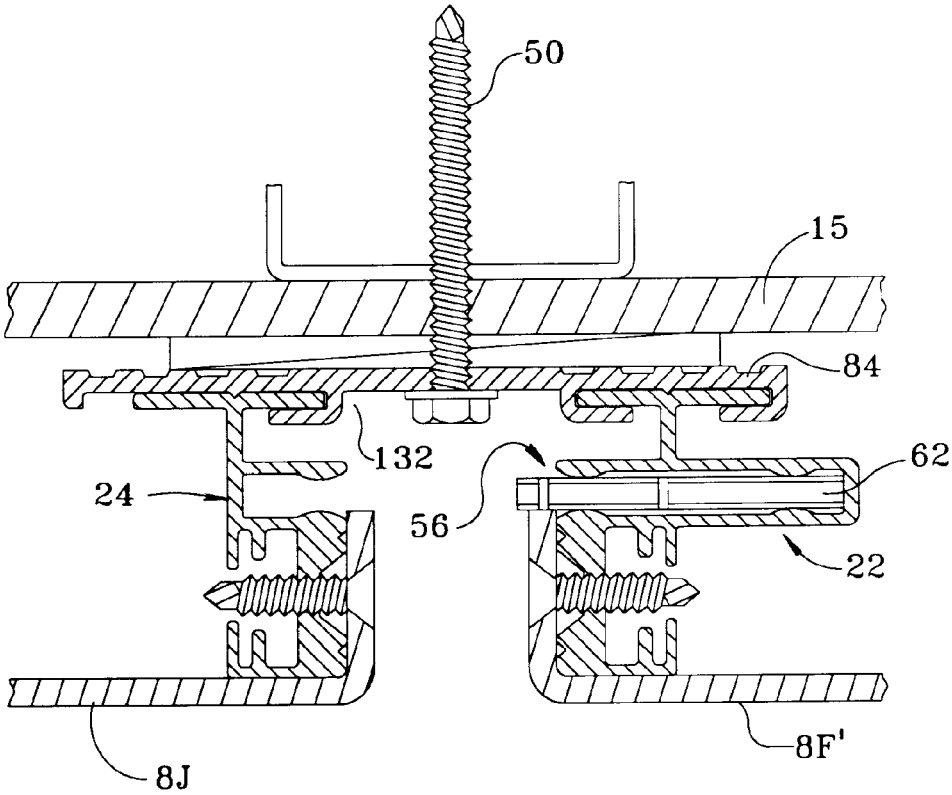
FIG. 13 is a side view of another step in the panel replacement process, showing the installation of replacement panel 8F'.

The replacement panel 8F', with anchor clips 84 and panel joint filler strips 62 thereon, can then be positioned in the desired location upon the surface of the building. After the replacement panel 8A is properly positioned, such as shown in FIG. 13 (which includes both clip 132 and clip 84, and which are staggered with respect to each other such that clip 84 is behind clip 132), the anchor clips 84 can be affixed to the building surface via threaded fasteners 50, or other desired attachment means. This is the case because the anchor clips 84 are accessible, and are not blocked by the panel joint filler strips 62, since the strips are tucked within the deep pocket portions 56 of the mounting extrusion 22, such as shown in FIG. 13.

After all of the anchor clips 84 are secured to the surface of the building, the panel joint filler strips 62 can be moved into position, such as by using the sliding tool 112, as described above. Finally, when the panel joint filler strips 62 are in the final position, such as shown in FIG. 5, the adhesive material 118 can set, thereby securing the panel joint filler strips in this location.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An architectural panel system, comprising:

a plurality of architectural panels, with each panel including at least one folded edge portion;

a first mounting extrusion defined between a first distal portion and a first proximal portion, wherein said first distal portion is configured and arranged so that said folded edge portion of a first one of said architectural panels can be attached thereto;

a second mounting extrusion defined between a second distal portion and a second proximal portion, wherein said second distal portion is configured and arranged so that said folded edge portion of a second one of said architectural panels can be attached thereto;

a first anchor clip including a first attachment configuration that enables said first proximal portion to be slidably attached thereto;

a second anchor clip including a second attachment configuration that enables said second proximal portion to be slidably attached thereto; and a panel joint filler strip, wherein said first mounting extrusion includes a first pocket portion in an area between said first distal portion and said first proximal portion, wherein said second mounting extrusion includes a second pocket portion in an area between said second distal portion and said second proximal portion, wherein said first pocket portion and said second pocket portion are configured and arranged to cooperate with each other to seat said panel joint filler strip, and further wherein said first pocket portion is of a first depth and said second pocket portion is of a second depth that is different from said first depth.

2. The architectural panel system as defined in claim 1, wherein said first and second proximal portions are each generally T-shaped in cross-section.

3. The architectural panel system as defined in claim 2, wherein said first and second anchor clips each comprise:

a pair of elongated generally L-shaped members that are configured to cooperate to slidably receive said first or said second T-shaped proximal portion.

4. The architectural panel system as defined in claim 1, wherein said first pocket portion is of a depth that is at least three times a corresponding depth of said second pocket portion.

5. The architectural panel system as defined in claim 1, wherein said first pocket portion is of a depth that is slightly smaller than a width of said filler strip so that when said filler strip is inserted into said first pocket portion, only a small portion of said filler strip extends outside of said first pocket portion.

6. The architectural panel system as defined in claim 1, wherein said first distal portion and said second distal portion are both generally U-shaped in cross-section.

7. The architectural panel system as defined in claim 1, wherein:

said first and second proximal portions are both generally T-shaped in cross-section;

said first and second pocket portions are both generally U-shaped in cross section; and said first and second distal portions are both generally U-shaped in cross-section, wherein an opening of said U-shaped first distal portion faces an opposite direction from an opening of said U-shaped first pocket portion and an opening of said U-shaped second distal portion faces an opposite direction from an opening of said second pocket portion.

8. The architectural panel system as defined in claim 7, wherein:

said first T-shaped proximal portion is directly connected to one leg of said first U-shaped pocket portion and another leg of said first U-shaped shaped pocket portion is shared with said first U-shaped distal portion; and said second T-shaped proximal portion is directly connected to one leg of said second U-shaped pocket portion and another leg of said second U-shaped shaped pocket portion is shared with said second U-shaped distal portion.

9. The architectural panel system as defined in claim 1, wherein said panel joint filler strip includes a pair of holes for receiving a sliding tool that facilitates movement of said panel joint filler strip with respect to said second pocket portion.

* * * * *